US010202259B2

(12) United States Patent
Scomparin

(10) Patent No.: US 10,202,259 B2
(45) Date of Patent: Feb. 12, 2019

(54) VERTICAL AND HORIZONTAL MOVEMENT SYSTEM

(71) Applicant: Pedarco International Limited, North Point (HK)

(72) Inventor: Tarcisio Scomparin, Treviso (IT)

(73) Assignee: Pedarco International Limited, Hong Kong (HK)

( * ) Notice: Subject to any disclaimer, the term of this patent is extended or adjusted under 35 U.S.C. 154(b) by 113 days.

(21) Appl. No.: 14/785,803

(22) PCT Filed: Apr. 16, 2014

(86) PCT No.: PCT/IB2014/000558
§ 371 (c)(1),
(2) Date: Oct. 20, 2015

(87) PCT Pub. No.: WO2014/174353
PCT Pub. Date: Oct. 30, 2014

(65) Prior Publication Data

US 2016/0075533 A1 Mar. 17, 2016

(30) Foreign Application Priority Data

Apr. 23, 2013 (IT) ..... TV2013A0057

(51) Int. Cl.

| | |
|---|---|
| ***B66B 9/00*** | (2006.01) |
| ***B66B 9/02*** | (2006.01) |
| ***B61B 5/02*** | (2006.01) |
| ***B61C 11/04*** | (2006.01) |

(Continued)

(52) U.S. Cl.
CPC ..... *B66B 9/003* (2013.01); *B61B 5/02* (2013.01); *B61C 11/04* (2013.01); *B61C 13/04* (2013.01);

(Continued)

(58) Field of Classification Search
CPC ..... B66B 9/003; B66B 9/022; B61B 5/02; B61C 11/04; B61C 13/04; B61H 9/00; B61L 27/04
See application file for complete search history.

(56) References Cited

U.S. PATENT DOCUMENTS 531,625 A * 1/1895 Dennis ..... B66B 9/022 187/271
1,392,078 A * 9/1921 Ouillett ..... B66B 9/02 187/271

(Continued)

FOREIGN PATENT DOCUMENTS

FR 2638439 * 10/1988 ..... B66B 11/04

*Primary Examiner* — Michael A Riegelman

(57) ABSTRACT

Vertical and horizontal movement system of one or more cabins (20) for the transport of people and things in a elevator shifter plant with portal structure (10) for the overcoming overhead and not, back and forth even automatic, obstacles such as roads, railways, waterways and other obstacles affected by driveways and not, especially for pedestrians, usable either in an overhead manner that underground and also incorporated in large buildings such as hospitals, airports, railway stations and so on, with two or more runaways running horizontally and vertically, in which one or more runways include vertical and horizontal stops and descents placed at different levels to overcome obstacles also passing under the same; operated by rack, wherein the motor is rigidly coupled to the cabin and acts via a pinion gear on the rack, having inclined toothing, to increase the fluidity of the movement reducing vibration and noise.

6 Claims, 12 Drawing Sheets

(51) Int. Cl.
*B61C 13/04* (2006.01)
*B61H 9/00* (2006.01)
*B61L 27/04* (2006.01)

(52) U.S. Cl.
CPC ..... *B61H 9/00* (2013.01); *B61L 27/04* (2013.01); *B66B 9/022* (2013.01); *B66B 2009/006* (2013.01)

(56) References Cited

U.S. PATENT DOCUMENTS 3,658,155 A * 4/1972 Salter ..... B66B 9/00 187/270
3,866,717 A * 2/1975 Johansson ..... B66B 5/04 187/270
4,516,663 A * 5/1985 D'Alessio ..... B66B 9/022 187/270
5,165,277 A * 11/1992 Bossen ..... G01N 23/16 248/647
5,558,181 A * 9/1996 Bundo ..... B66B 9/022 187/270
6,923,612 B2 * 8/2005 Hansl ..... B65G 1/0435 414/277
2005/0056493 A1 * 3/2005 Molnar ..... B66B 9/025 187/271
2014/0124293 A1 * 5/2014 Eversole ..... B66F 3/02 182/103
2014/0224147 A1 * 8/2014 Scomparin ..... B66B 9/003 104/107
2015/0083524 A1 * 3/2015 King ..... B66B 9/00 187/249

* cited by examiner

VERTICAL AND HORIZONTAL MOVEMENT SYSTEM

The present invention describes a vertical and horizontal movement system of one or more cabins for the transport of people and things in an elevator shifter apparatus with a portal structure for the overcoming overhead and not, back and forth even automatic, of obstacles such as roads, railways, waterways and any other obstacle affected by driveways and not, particularly for pedestrians, usable either in an overhead that underground manner and also incorporated in large buildings such as hospitals, airports, railway stations and so on.

APPLICATION'S FIELD

The crossing of obstacles, such as the routes for the movement of wheeled vehicles, railways and waterways, by pedestrians, cycles or goods such as bicycles, typically takes place through flush width crossing, bridges or subways. Assuming flush width crossing, which constitute the absolute majority of cases, even when they are assisted by traffic lights, it is observed that are somewhat dangerous, especially for pedestrians and cycles, as it is used substantially the same physical space, giving rise to collisions and accidents. The traffic light systems, while adjusting the alternating crossing of pedestrians and vehicles, requires the arrest of the latter with the inevitable waste of energy, the emission of polluting fumes and the formation of queues. Pedestrians and the environment are thus subjected to greater contamination. The elevated bridges and subways instead get the physical separation of the flows. They have however the drawback of being expensive and occupy a lot of space. In addition to the stairs or ramps, they require the addition of elevators specially dedicated to people with disabilities. The underground passages, are the most expensive both for their construction that for their maintenance. In some cases, they are totally impractical for the presence of obstacles such as water or gas pipes, conduits, subways, tunnels, archaeological or geological or adverse geostationary conditions. Finally, subways, being uncomfortable places and hidden, are often the scene of crimes and are often avoided by many people. Even the overcoming of obstacles of a different nature, such as waterways, takes place with bridges and underpasses.

STATE OF THE ART

A brief search in the context of patent applications and granted patents, while not extensive, has allowed to identify the following prior art documents:

D1 FR2638439 (A1) (OTIS ELEVATOR CO [US])
D2 U.S. Pat. No. 3,698,326 (A) SCHURCH EUGEN ET AL [DE]
D3 EP1574467 (A1) MITSUBISHI ELECTRIC CORP [JP]
D4 TV2010A000149 SCOMPARIN TARCISIO [IT]
D5 JP2002370881A (Yazawa)
D6 CN201296896Y ZONGMING ZHU [CN]
D7 CN101314449 Xin
D8 CN 101391720 Xinqi D1 Describes a transfer lift that comprises a cabin which is driven along the supporting structure by at least two independent drive systems respectively producing the raising or lowering movements of the cabin on the uprights of the structure and the translation of the cabin along the main top portion of the structure.

D2 Describes a construction of a transport unit designed for the suspension thereat of suitable load-carrying containers of an overhead conveying system, the transport unit embodying two undercarriages, that are operatively coupled by a coupling mechanism of the invention. This coupling mechanism comprises means for pivoting frame incorporating a support frame having two support arms, and in which the coupling mechanism comprises at most two pairs of swivel joints arranged to the axes of rotation that are arranged substantially perpendicular to each other.

D3 Describes an elevator apparatus in which a first car and a second car connected with opposite ends of a main rope are able to land at the same time. The construction is such that the first and second cars are connected with the opposite ends of the main rope wrapped around a sheave and a deflector wheel, respectively, and a landing correction device for vertically moving a cab of the second car with respect to a car frame is arranged between the cab and the car frame. After the first car has landed on a set landing floor, the cab is moved up and down with respect to the car frame by the landing correction device, whereby a landing deviation of the second car can be corrected.

D4 Describes a handling system for a cabin movable transportation for the transport of people and things along an overpass consists of a "U" portal, in a urban elevator shifter plant, of the overhead type overhanging the obstacle and that connects two stations of departure and arrival opposite to each other, said overpass that includes columns and guide beams to which the said cabin is constrained by means of slide means apt to perform the horizontal movement with respect to the guide beams, with carriage means apt to perform the vertical movement with respect to the guide columns said carriage means being of the type engageable with said slide means to accomplish the vertical movement with respect to said guide columns, and wherein the said cabin is moved vertically and horizontally by means of a closed chain ring which is constrained to the slide, said chain being of the type driven by a motor.

D5 Proposes a device consisting of two elevators arranged at the end of a bridge of interconnection, connected to each other by means of ropes so that the cabin of one constitutes the counterweight of the cabin of the other and vice versa so that while the cabin of one raises the cab of the other goes down. It's nice to look at, it produces a saving of space, can be installed on existing bridges. This elevator device for an air bridge of interconnection comprises a first elevator placed at an extreme point of the air bridge of interconnection that reciprocally separates two points and a second elevator disposed in the opposite point. First and second elevator are reciprocally connected by a main rope with lifting and connection functions, that passing laterally, under or over the same bridge of the interconnection within an internal appropriate passageway, transfers the carrier action of the cabin of the first elevator to cabin of the second elevator.

D6 Describes a pedestrian bridge with a glass wall vertical elevator, comprising a main bridge and pedestrian stairs arranged at both ends of the main bridge. The bridge is supported by piers arranged between the bottom surface of the bridge and the ground. The vertical elevator at one or both ends has an input/output of the bridge facing the walkway. The solution combines a pedestrian bridge with a vertical elevator with curtain walls or glass and is made with known materials and technologies, fulfills the functions which it is intended for, has a good resistance to vibration and ultimately allows to enjoy the urban landscape.

D7 proposes an automatic elevator to overpass, which adopts "H" shaped guides to allow a platform the ascent and descent. Said "H" shaped guides are obtained in steel and are combined in parallel, and a traction machine is positioned in the upper part of said guides. A platform for elevation is with an end apt to support the passengers, the other end being engaged by sliding means to said "H" shaped sliding guides. The traction device consists of cables and counterweights so as to be able to lift the said platform.

D8 Suggests a device for the easy passage of intersections capable of replacing a traffic light. It regards in particular of a curved guide rail with a cabin hanging which moves to and fro along said guide rail connecting two elevated platforms served by stairs, where said elevator cabin is moved by a traction device that is coupled to said cabin.

Ultimately it is therefore reasonable to assume known:

a) A transfer lift that comprises a cabin which is driven along the supporting structure by at least two independent drive systems respectively producing the raising or lowering movements of the cabin on the uprights of the structure and the translation of the cabin along the main top portion of the structure;

b) A transport unit designed for the suspension thereat of suitable load-carrying containers of an overhead conveying system, the transport unit embodying two undercarriages, that are operatively coupled by a coupling mechanism of the invention. This coupling mechanism comprises means for pivoting frame incorporating a support frame having two support arms, and in which the coupling mechanism comprises at most two pairs of swivel joints arranged to the axes of rotation that are arranged substantially perpendicular to each other;

c) An elevator apparatus in which a first car and a second car connected with the opposite ends of a main rope are able to land at the same time. The construction is such that the first and second cars are connected with the opposite ends of the main rope wrapped around a pulley and a deflector wheel, respectively, and a landing correction device for vertically moving a cabin of the second car with respect to a car frame is arranged between the cabin and the car frame. After the first car has landed on a set landing floor, the cabin is moved up and down with respect to the car frame by the landing correction device, whereby a landing deviation of the second car can be corrected;

d) A system of vertical and horizontal movement of at least one cabin transport of people and things in an elevator shifter plant for passing to and fro overhead also in automatic of obstacles such as roads, highways, intersections and any other obstacle affected by driveways, particularly for pedestrians;

e) An elevated walkway to the pedestrian, positioned substantially transverse with respect to the obstacle, such as the passage of a road, where the said passage comprises at least two opposite flights of stairs and a connecting bridge or overpass, said flights of stairs each being positioned at one end of said bridge and insistent to the ground from the side of relevance;

f) Two elevators, located close to the stairs that allow the lifting of the pedestrian from the ground up to the height of the pedestrian bridge that crosses the said road and vice versa;

g) The use of a balancing system of the cabins of two elevators placed at the ends of a pedestrian bridge whose lifting rope is mutually connected so that the ascent of one corresponds to the descent of the other;

h) The use of glass, for the elevators in order to make the structure less impact from the point of view of the environment and at the same time pleasant for the user;

i) The use of a transmission system for the elevation of the cabin, rope and counterweights, with a traction device positioned at the upper end of the vertical guides/rails;

l) The use of a translation system of a cabin suspended from a first end to a second end of a pedestrian crossing, which cabin uses a handling system that provides for roto-mechanical means on the top part of the same which engage the rack guide that is positioned to span at arch across the obstacle to overcome.

Drawbacks

In principles, we can identify some common problems that relate to the known solutions in the implementation of an efficient system, apt of handling a combined movement of at least a cabin in both vertical and horizontal directions, that prevent the use of easy solutions, flexible, and particularly efficient. In this case some of the factors that contribute to these important limitations and difficulties, can be so listed below:

presence of wheels on the bottom of the cabin, who insist on separate complex guidance systems; considerable dimensions under the cabin due to the presence of shelves that support it inferiorly; frequents accumulations of dirt and debris, such as snow, on the movement guides of the cabins;

possible stability problems of the cabin due to the cabin guide points which generally are very close to each other;

little roomy cabins usually because the transverse dimension of the cabin cannot increase without affecting the lateral guidance system; handling systems as disclosed in D1 to the middle rope also double and/or by ring required only for the horizontal movement of the cabin and to solve the need to maintain taut said rope and to move in both directions the same rope also along the horizontal portion;

presence of the hook integral with this rope that hooks to the cabin when it is in an elevated position and moves from side to side of the span; movement of the cabin vertically via complex winch with ropes and sliding and guide skates that raise vertically shelves along the columns of movement; needs of many motors, cables, pulleys and skates;

inability to realize the continuous radius movement of the cabin in the changes of direction;

precarious safety because the cabin engages and disengages from the system at each stroke of horizontal movement, as for example in D2 where it provides a system of rail that may follow horizontal and vertical paths, as well as rotate with respect to the vertical axis, along which moves a sledge with wheel drive (driven by motor) and other freewheels. In this sledge is hanging from the cabin through the hooks in the shape of a disk (on the sledge) that fit within some semi-circular hollows (on the cabin). It is noted, therefore, that the said system in D2, presents serious problems of practical operation, especially in the case of the vertical path, where the weight of the cabin could not be sustained only by the friction of the wheels on the rails, as the cabin, unless of inserting other mechanisms that stabilize it, continues to oscillate due to the same movement (acceleration and deceleration) and, still more, due to the change of direction and, there is no change in the magnitude of the counterweight system applied according to the actual load which insists on the cabin;

D3 instead, provides an elevator system (double) with two cabins constrained to a single cable (rope or chain) that runs, at the top, around some pulleys. These cabins balance each other for only its own weight but not for the load, and move in opposite directions. D3 then provides two alternative systems for compensation of the length of the cable, whose expansion, would cause misalignment of the cabins respect to the planes, that is, one that acts raising and lowering, by means of a suitable motor, one of the two cabins with respect to a frame through which is constrained to the cable, and another through the passage at the top of the cable on two opposing pulleys that are pulled closer between them or pushed further away by means of an hydraulic cylinder or other system so as to determine a variation of the useful length of the cable in whether its extremes. All the solutions presented in D3 can be inferred as highly complex and intricately unreliable;

by summarizing what is known, are noted, thus:

a) a considerable waste of energy due to the presence of numerous linkage devices (pinions) and numerous guide elements, both horizontally and vertically; in the case of chains, considerable warping as a significant direct consequence of the considerable lengths, resulting in noise at the entrance with the pinions and/or skates guides;

b) considerable intrinsic noise arising from the eccentricity proper of the chain/pinion system; significant decrease (warping) along the horizontal sections due to the weight of the chains, resulting in the need to introduce many pinions and/or many skates of support;

c) in the case of chains or ropes, high fluctuations "by pendulum" in the long vertical sections with consequent triggering of micro variations in load and speed;

d) in the case of chains or ropes, remarkable elasticity, with consequent variation of the length as the load varies;

e) in the case of chains or ropes, significant dimensional alteration over time due to wear and stretching; consequent need for frequent calibrations and pre-tensioning;

f) in the case of chains or ropes, tendency to derailment due to the dimensional variations due to elasticity and bending;

g) in the case of chains or ropes, difficult to control the position of the cabin, especially when it is moved while it is distant from the motor pinion through a long stretch of chain (distance between the motor pinion and constraint cabin);

h) in the case of chains or ropes, "Stick-Slip" effect (bonding) resulting in tears when initiating the movement, gradually worsening at the increasing of the distances between engine pinion and cabin bond;

i) in the case of chains, limitation in the maximum speeds of movement (speed limit proper of the chains);

l) in D4 for example, such a system of chains movement, although being beneficial in terms of cost and performance, presents some of the limitations mentioned above, related precisely to the use of chains;

m) furthermore, the existing solutions which provide a single cabin that moves to and fro from one side of an obstacle have the limitation of being able to carry a limited number of persons and/or things in a certain period of time;

n) such quantity is related to the capacity of the cabin itself and to its speed (time with which it can be transferred from one side to the other of the obstacle);

o) exist then solutions that show similar movement systems of a number of cabins;

p) between these systems is highlighted the handling system which realizes, for example, a catenary system that moves a series of cabins along a loop path in the shape of an upside-down "U" above an obstacle;

q) such a system in the form of cableway allows to have more cabins that realize the transport of people and things, theoretically increasing the transport capacity per unit of time;

r) the limitations and disadvantages of the known prior art are however:

Significant obstruction of ground stations;

Constraint of movement for the cabins, which must provide for a predetermined time of loading and unloading which also affects the movement and in some cases also on the loading and unloading of other cabins;

Cost and bulk of the handling systems and their high energy consumption;

In the case of consecutive obstacles, such as the rails in a train station that includes more than two quays, solutions are not known found that, similar to those mentioned in the preceding paragraphs, are able to overcome all at once or only a part of these obstacles according to the choice of the user. There is therefore the need of a variety that is able to achieve the transport of persons and things in a fast and convenient way over one or more consecutive obstacles with the possibility to choose an intermediate destination placed in between these obstacles.

In the systems mentioned in the previous paragraphs, there may be applications in which the vertical lines between them are of different heights and/or there are along the vertical sections some stops placed in multiple positions on multiple different planes between them. It is therefore necessary to develop an invention that achieves the same time the energy recovery of which the hydraulic adaptive system mentioned and at the same time it allows for the movement of loads to and from different planes.

In the systems mentioned in the previous paragraphs, when they are not protected by superstructures of containment, there is the problem of isolation and protection of the guiding devices, movement and connection of the cabin and the load-bearing structure. A simple system of protection of the compartments that house the devices, has been foreseen in the solution found in D4, which consists in the application of protection brushes similar to the brushes of the industrial pontoons, that close the openings within which move the connection elements between the different fixed and mobile parts of the system.

Such brush system results however ineffective, little durable and sensitive to the actions which tend to deform the bristles that make up the same. It is therefore necessary to develop a new-found able to avoid the infiltration of water, dust, animals, etc., within the compartments that contain the mechanisms of the system of horizontal movement when the same is installed in a specific preset environment.

In the systems mentioned in the previous paragraphs is crucial in order to obtain the best result in terms of transport capacity per unit of time, to determine the strategy with which you move the single cabin or series of cabins. In fact, it is desirable that the system responds appropriately to the stresses that are addressed in an indirect way by users. Especially the presence of two or more cabins and the possibility to move them in an autonomous way between them, requires to be able to determine their movement in an intelligent and coordinated way. It is therefore necessary to develop a system that can optimize the movements of the cabins possibly anticipating the users requests.

In the systems mentioned and proposed in the previous paragraphs, where provision is made for the balancing system with adaptive hydropneumatic accumulators, hydraulic cylinders and devices with chains because of the problems that arise when the same should be moved horizontally, especially in cases where the runways of the horizontal sections are particularly long and/or if there are more than two verticals runways, results difficult to use chains devices. It is therefore necessary to develop a new-found able to effectively accomplish the same function of the chains and/or allow the transfer of hydraulic energy between more than two systems of hydraulic springs in the same elevator shifter plant.

In the proposed systems mentioned in the preceding paragraphs and, where provision is made for the balancing system with adaptive hydropneumatic accumulators and hydraulic cylinders, especially in cases where the runways of vertical portions are particularly long, it is difficult to use hydraulic cylinders, especially if found between standard products commercially available. It is therefore necessary to develop a new-found able to effectively accomplish the same function of the hydraulic cylinders without presenting the same or other limitations.

Finally, in the systems mentioned and proposed in the preceding paragraphs is useful to be able to easily access all parts that may require inspection and maintenance. Among these pieces are undoubtedly the vertical and horizontal runways with all the related movement systems. It is therefore necessary to develop a new found so as to allow easy access to the organs of movement by a maintainer or whoever must checks the functionality, status, consumption, etc.

Considering all these aspects, it is quite evident the need for the industry to identify the most efficient and cost effective solutions under the economic profile.

BRIEF DESCRIPTION OF THE INVENTION

Vertical and horizontal movement system with portal structure, of at least one or more cabins, obtained by one or more motors rigidly coupled to the cabin or to the elements which allow the movement (skates, carriages), with pinions acting on racks or with wheels on guides, even with more than two horizontal runways, and one or more vertical runways, provided with a system of adaptive hydraulic balancing with recovery of energy that does not use chains or ropes for reference on the horizontal sections, in which one or more runways provide vertical intermediate stops or stations placed at different levels. Power system with sliding contacts in a fixed part and a movable part with respect to the structure, for the motor power supply and services integral within the cabin. System of protection of the organs of movement, with fixed and mobile covers. Mounting and suspension cabin system provided below it. Control system of vertical and horizontal movement with motion optimization of one or more cabins according to the physical characteristics and behavior of the users and the approaching movement of users, is recognized and supported by an artificial vision system and processed by an artificial intelligence system capable of constraining the operation based on the characteristics and behaviors of users. Hydraulic balancing of adaptive type for vertical movement of cabins in the elevator shifter system, with use of connecting pipes between different systems of hydraulic spring and combined series of pumps/hydraulic motors with different flows. Immediate and easy access to the moving parts of the cabin.

Aims and Benefits

The solution shown here, offers numerous aims and benefits, which are not to be considered limiting, being able to identify the additional hereafter, which although not mentioned, however, must be included.

A first aim and benefit consists of employing an elevator and shifter with a portal structure of at least one cabin, rack or equivalent system, for example with fixed chain, where the motor is integral to the cabin or to an element (slide) to it supportive, and acts through a pinion gear on the rack or on the fixed chain. To achieve a trajectory curve in correspondence with the inversion of the movement from vertical to horizontal and vice versa, which the junction between the vertical and horizontal strokes, it is used a segment of a rack-shaped curve in the form of a circular pinion sector. In the case of the rack, to increase the fluidity of movement with less vibration and low noise of the system thus increasing the comfort of the passengers in the cabin, it's possible to use an angled toothing.

A second aim and benefit is to provide a system of vertical and horizontal movement with portal structure with more of a cabin and with two or more horizontal runways and, a vertical and horizontal movement system with one or more cabins with more than two vertical runways and one or more horizontal runways, in which one or more runways provide vertical intermediate stops or stops placed at different levels, and wherein one or more runways provide horizontal and descents intermediate stops posed also at different levels and that can overcome obstacles also passing under the same.

A third aim and benefit is to optimize the movement of one or more cabins according to the movement of the users that is detected by artificial vision system or other system of sensors and processed by artificial intelligence system, which takes account of the shape, the size and behavior of users. Said system intervenes in the control of the waiting times, the speed of opening and closing the doors, the sequence of priority and speed of movement of the cabin or the cabins; it also intervenes using and adjusting the audio and visual media that allow users to receive information from the system itself.

A fourth aim and benefit consists in the realization of an adaptive hydraulic balancing system with energy recovery, with connecting pipes between the various systems of the spring, without the use of chains in the horizontal sections and with use of the combined series of pumps/motors with hydraulic different flow rates.

A fifth aim and benefit consists in the realization of a system with more than one cabin the use of two pairs of carriages on the same path of the vertical runway to achieve the simultaneous movement of more than one cabin on the same route of the vertical runway and, in the case of more than two vertical runways, to ensure the passage of a cabin from one horizontal runway to another horizontal runway adjacent, overpassing the same vertical runway considered.

A sixth aim and benefit is to employ a pair of motors placed on the sides of the cabin or on the sledges that support it, which motors acting separately with an electronic synchronism via encoder and closed loop control, or as a couple through a shaft of synchronism. This shaft of synchronism can be conveniently placed beneath the cabin or housed in the floor of the same so as not to constitute alley and hindrance.

A seventh aim and benefit is that in the vertical sections, the said rack can be used to ensure the parallel movement of the carriages which in turn move vertically the sledges to which is integral the cabin. To achieve this there is provided a shaft synchronism at each end provides a toothed pinion which meshes on the rack in its vertical portion.

An eighth aim and benefit consists of the use of two separate motors which can also realize a security system allowing the movement of the cabin even if one of the two motors or its control system is faulty. The motor or motors will be equipped with brake Shunts, similar to that used in the electric winches for elevators, in addition to traditional electromagnetic brakes, so as to ensure the maintenance in position of the cabin even in case of power failure as a consequence of failure or for simply stationary purposes.

A ninth aim and benefit is that to counter the forces that characterize the pinion/rack and pinion/chain, which would tend to dismiss them between the two elements, is prepared a special thrust bearing and guide pin concentric to the axis of the toothed pinion, which acts on a specific area of thrust bearing suitably shaped to follow and impose the movement of the pin itself.

A tenth aim and benefit consists in a system of protection of the organs that perform the horizontal movement of the cabin, given by a cover which completely covers from the left such organs along the horizontal runways, allowing to support the cabin through the shelves that pass below said cover, sliding through an opening that is directed toward the bottom and which therefore prevents foreign elements contaminating the compartment of the organs of movement along the horizontal runways.

An eleventh aim and benefit obtained by means of the support of the cabin from the bottom of the same, consists in the access to the organs of movement of the cabin, achievable directly from inside the cabin itself through the lateral openings, closed by removable doors, which allow access to runways, once removed, for example, the relative lateral protections.

A twelfth aim and benefit is to increase the speed of movement of the cabin given by the use of racks and pinions in place of mobile chains.

A thirteenth aim and benefit is to reduce the overall dimensions of the structures and mechanisms and simplification of maintenance.

In conclusion, these benefits have the advantage but not least, to achieve a system of vertical and horizontal movement of the transport cabin in an elevator shifter system with portal structure with a good technological content.

These and other benefits will appear in the following detailed description of some preferred embodiments with the aid of the attached schematic drawings, whose details of execution are not to be considered limitative but only and exclusively illustrative.

CONTENT OF THE DRAWINGS

Figure 9A:
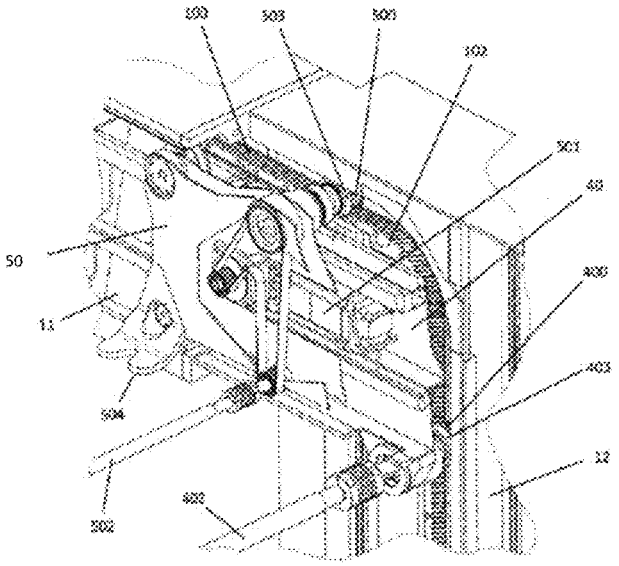
Figure 9B:
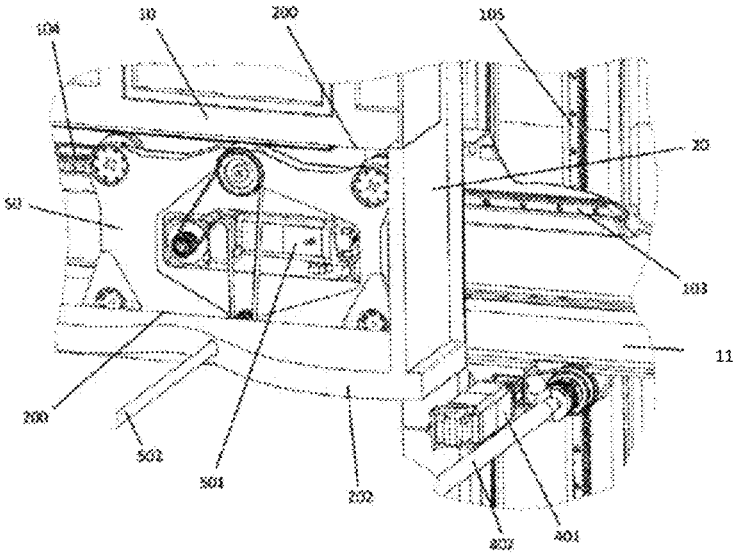
Figure 10A:
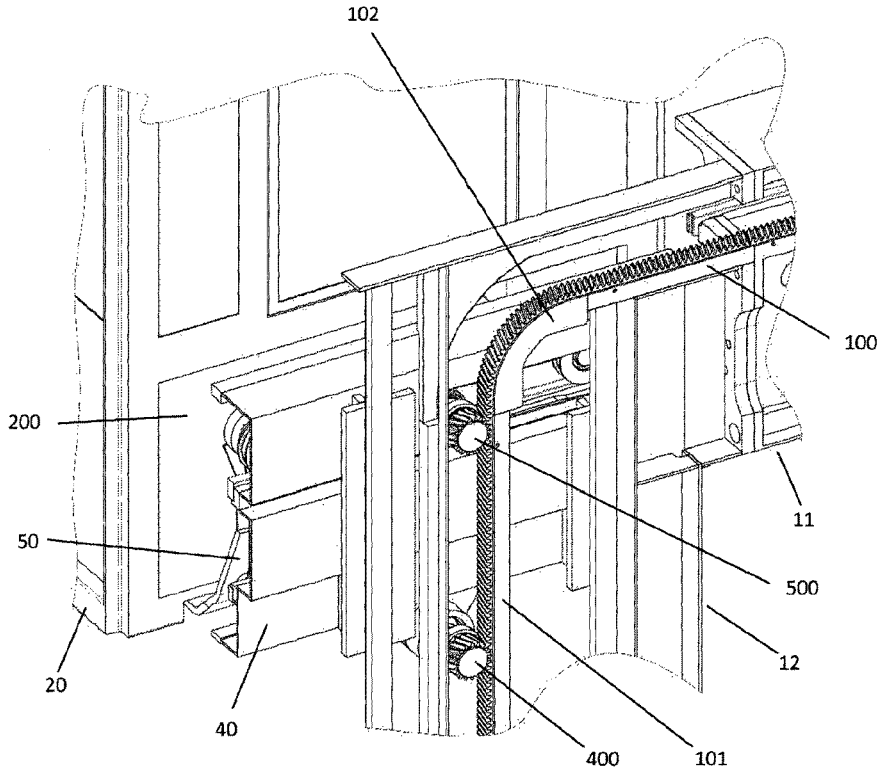
Figure 10B:
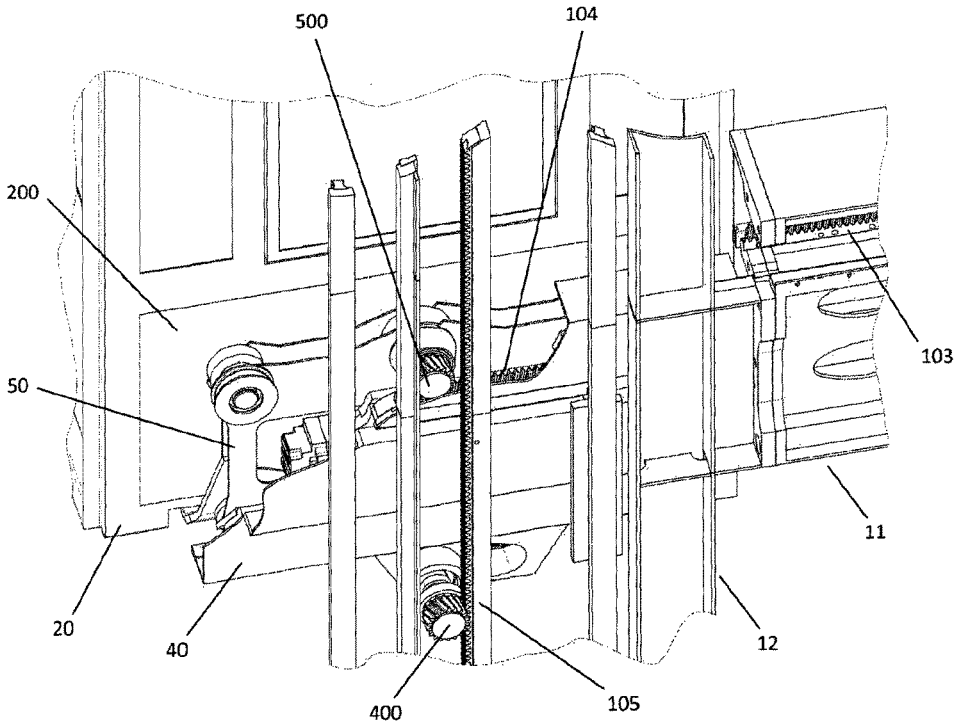
Figure 11A:
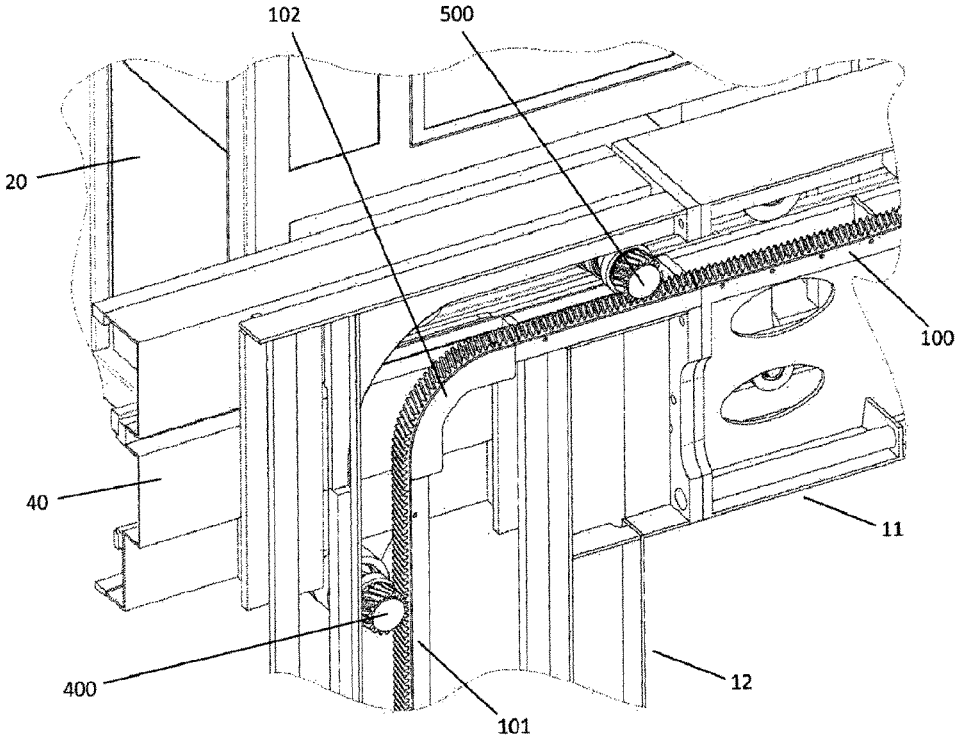
Figure 11B:
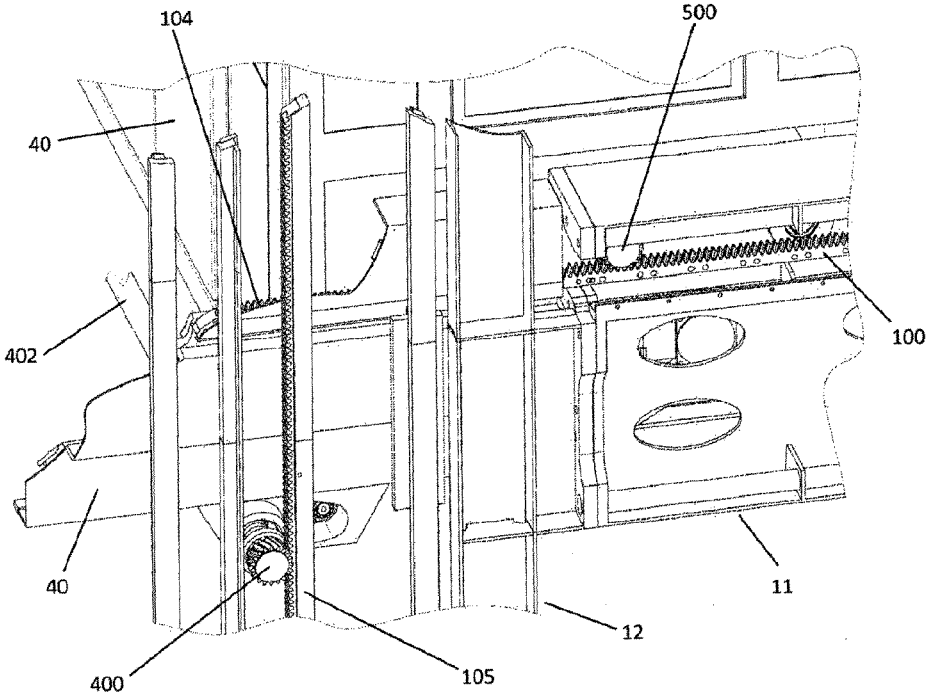
Figure 12:
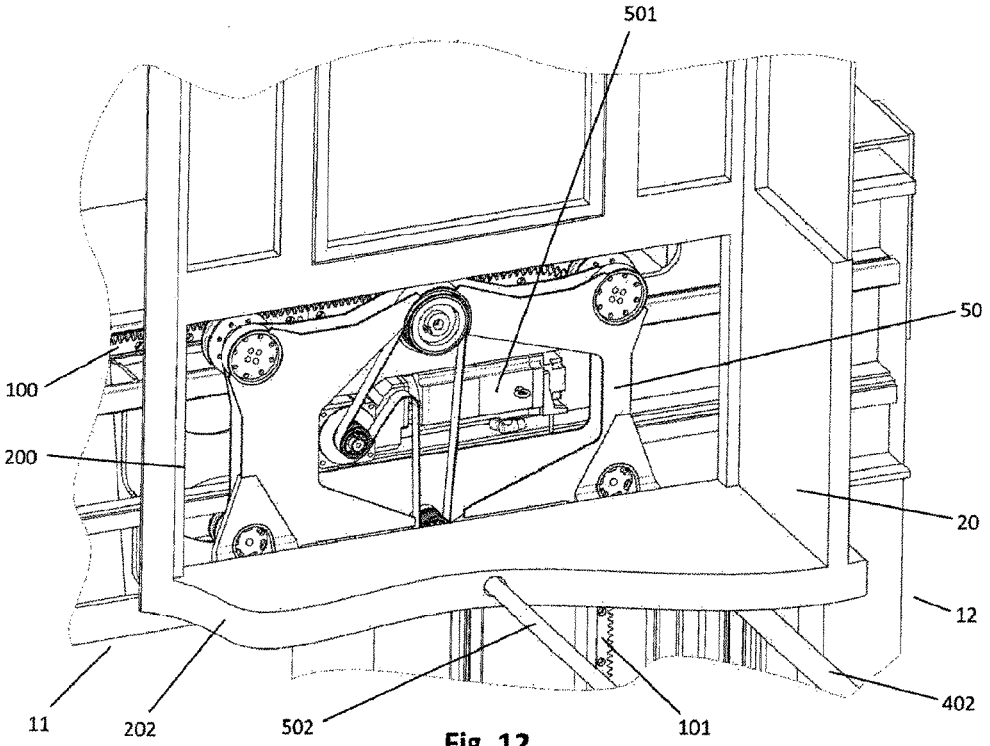
Figure 13:
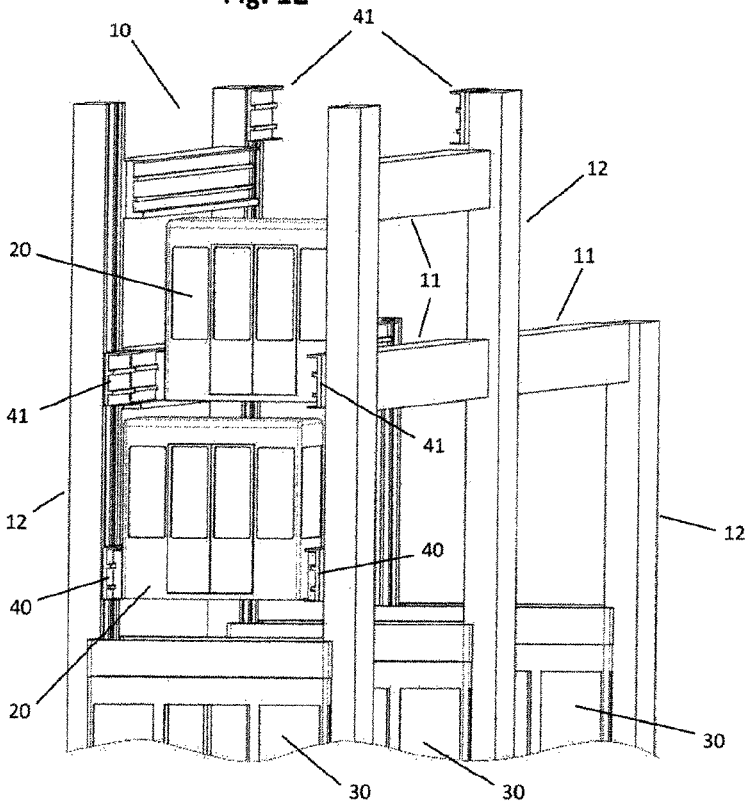
Figure 14:
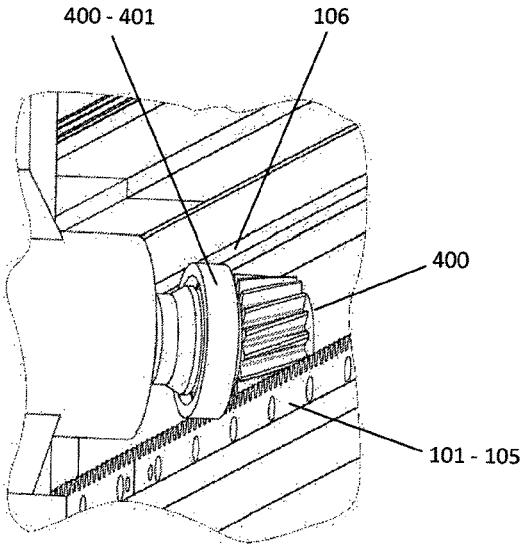
Figure 15:
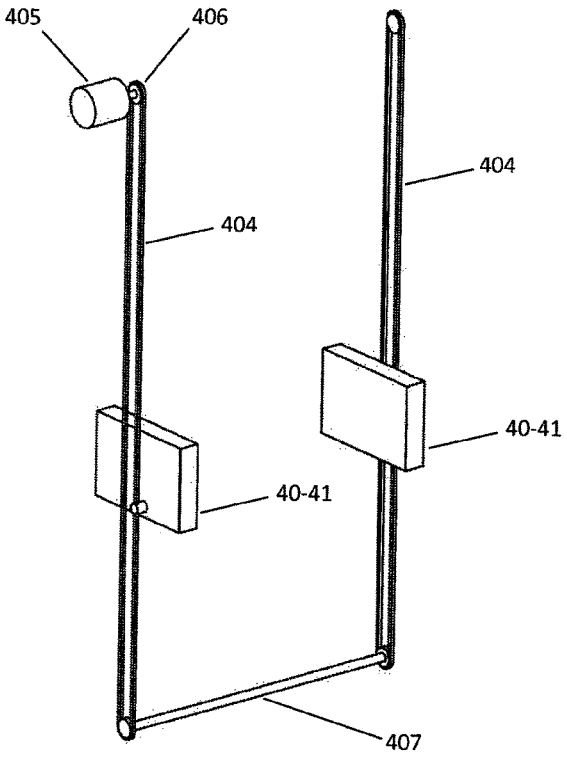
Figure 16:
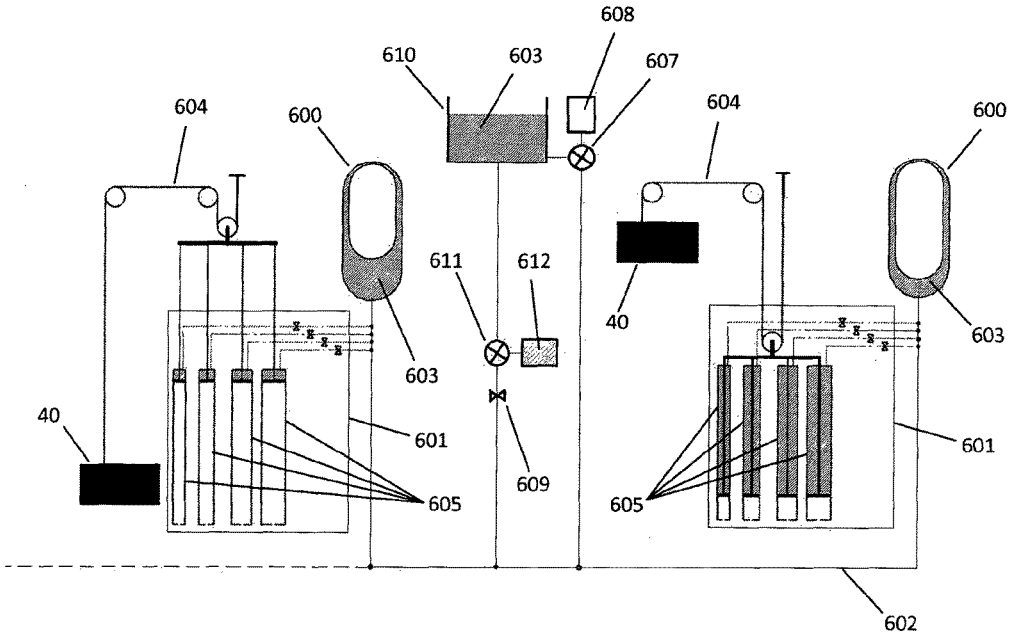
Figure 17:
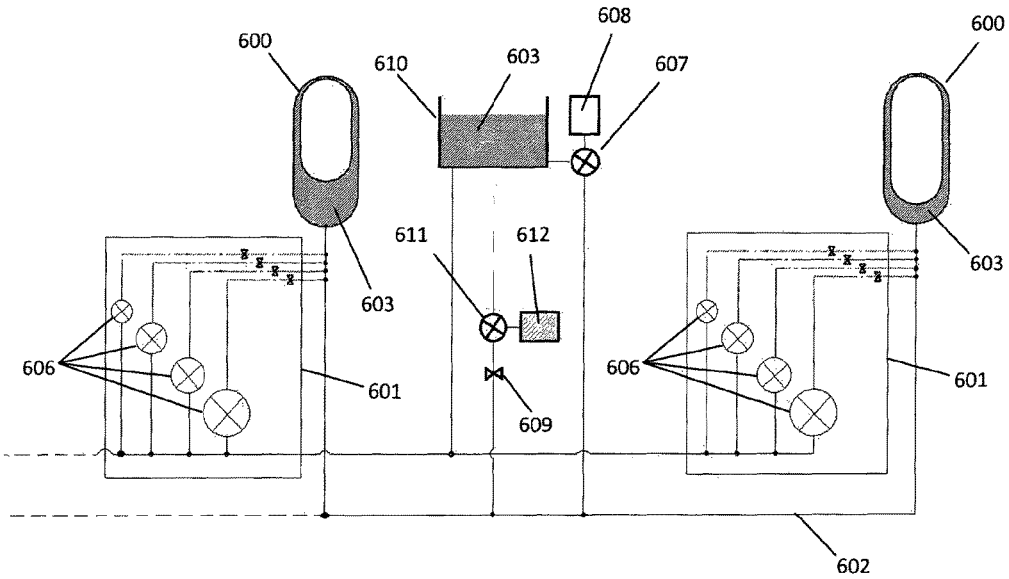
Figure 18:
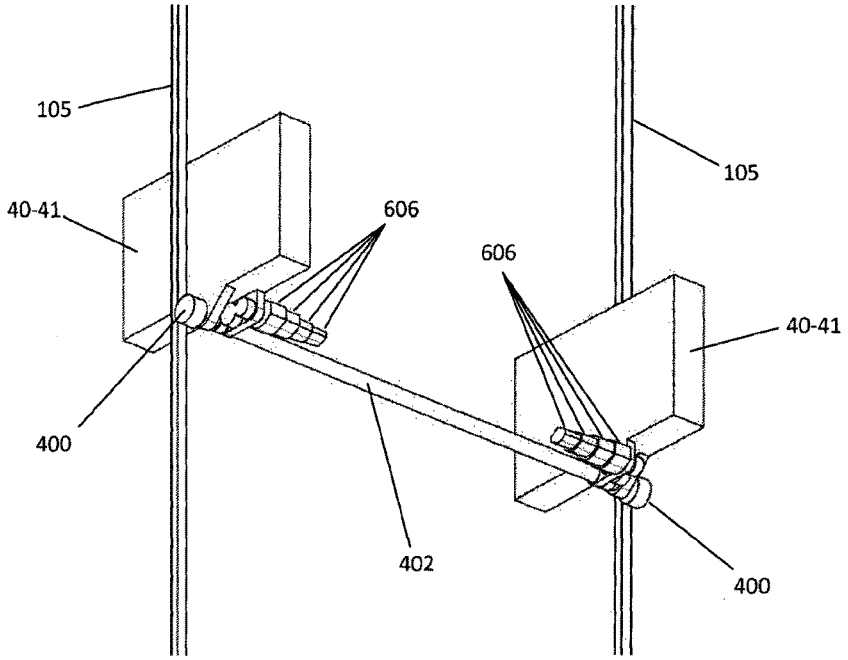
Figure 19:
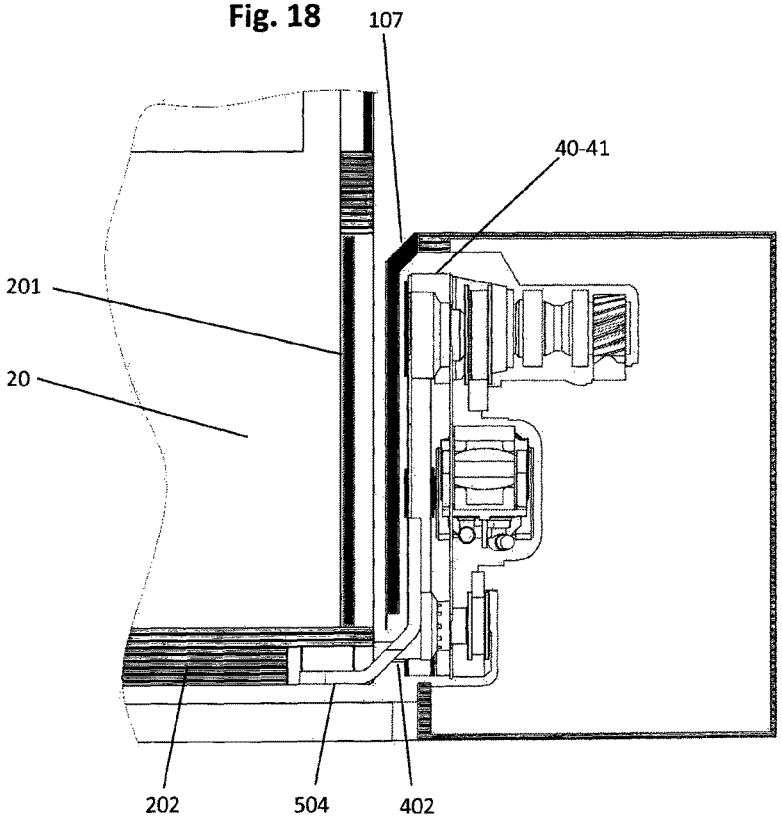
Figure 20:
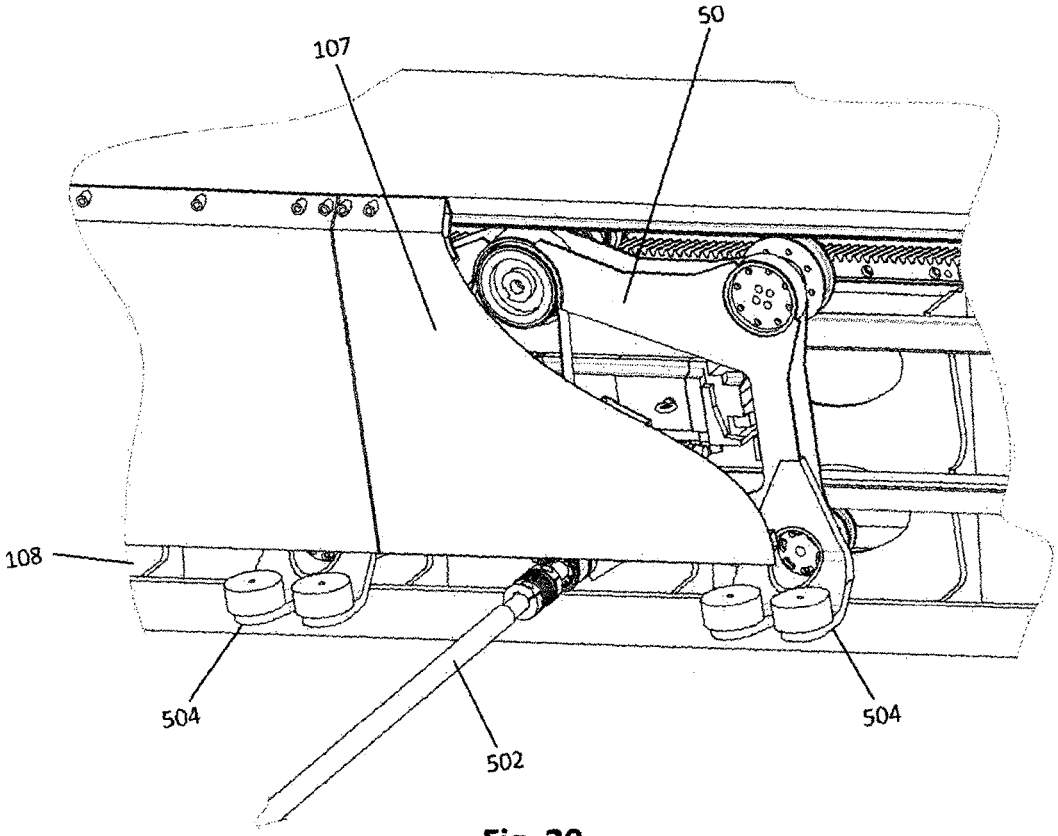

FIG. 9*a* is a partial cross-section without cabin (20) of the crossing of the horizontal runways (11) and vertical runways (12) of the urban elevator shifter system with portal structure (10), with a single cabin of transport (20) provided with racks (100) and curved rack segment (101);

FIG. 9*b* is a partial cross-section of the crossing of the horizontal runways (11) and vertical runways (12) of the urban elevator shifter system with portal structure (10), with one or more cabins of transport (20), with two or more horizontal runways (11) and/or one or more vertical runways (12) equipped with racks (100);

FIG. 10*a* is a partial cross-section of the crossing of the horizontal runways (11) and vertical runways (12) of the urban elevator shifter system with portal structure (10), with a single cabin of transport (20) equipped with racks (100) and curved rack segment (101), while the cabin (20) moves in the vertical path;

FIG. 10*b* is a partial cross-section of the crossing horizontal runways (11) and vertical runways (12) of the urban elevator shifter system with portal structure (10), with one or more cabins of transport (20), with two or more horizontal runways (11) and/or one or more vertical runways (12) equipped with racks (100), while the cabin (20) moves in the vertical path;

FIG. 11*a* is a partial cross-section of the crossing of the horizontal runways (11) and vertical runways (12) of the urban elevator shifter system with portal structure (10), with a single cabin of transport (20) equipped with racks (100) and curved rack segment (101), while the cabin (20) moves in horizontal;

FIG. 11*b* is a partial cross-section of the crossing of the horizontal runways (11) and vertical runways (12) of the urban elevator shifter system with portal structure (10), with one or more cabins of transport (20), with two or more horizontal runways (11) and/or one or more vertical runways (12) equipped with racks (100), while the cabin (20) moves in horizontal;

FIG. 12 is a partial cross-section from inside the cabin of transport (20) of the urban elevator shifter system with portal structure (10), with one or more cabins of transport (20);

FIG. 13 is a partial view of the urban elevator shifter system with portal structure (10), with one or more cabins of transport (20), one or more horizontal runways (11) and one or more vertical runways (12);

FIG. 14 is a detail of the toothed pinion (400 and 500);

FIG. 15 is a schematic representation of a system of movement of the carriages (40 and 41) for using of fixed motor (405) and chains (404) in the elevator shifter system;

FIG. 16 is a diagram of the hydraulic device for balancing the weight of the cabin (20) in the path sections of the vertical adaptive type of the elevator shifter system that uses a set of hydraulic cylinders (605);

FIG. 17 is a diagram of the hydraulic device for balancing the weight of the cabin (20) in the path sections of the vertical adaptive type of the elevator shifter system that uses a set of pumps/hydraulic motors (606);

FIG. 18 is a schematic representation of a system for balancing the carriages (40 and 41) in the elevator shifter system that uses a set of pumps/hydraulic motors (606);

FIG. 19 is a cross-section of the side of a cabin (20) and the compartment that contains the mechanisms for horizontal movement of a cabin in the elevator shifter system;

FIG. 20 is a partial view without cabin (20) of the covers (107) that protect the organs of the horizontal movement of a cabin in the elevator shifter system.

PRACTICAL IMPLEMENTATION OF THE INVENTION

FIGS. 1, 2, 3 and 4 represent some variants of the urban elevator shifter system with portal structure (10) for the crossing of obstacles, which integrates the movement systems of the present invention, which is essentially composed of a portal structure (10) which, in its simplest form, is typically in the shape of "U" turned upside down and is disposed so as to bypass one or more obstacles, with one or more cabins of transport (20) that move, for the via of the handling systems described hereinafter, in and from along the said portal structure (10), from a station (30) of departure to a station (30) of arrival and vice versa, where said stations (30) departure and arrival are formed at the ends of horizontal runways (11) or vertical runways (12) of the portal structures (10) or in intermediate positions of the vertical runways (12), constituting the intermediate stations (13), of said portal structures (10). Single cabin or more cabins of transport (20) are therefore movable, from a station (30) of departure to a station (30) of arrival and vice versa by means of said movement systems, both in vertical and horizontal.

Figure 2:
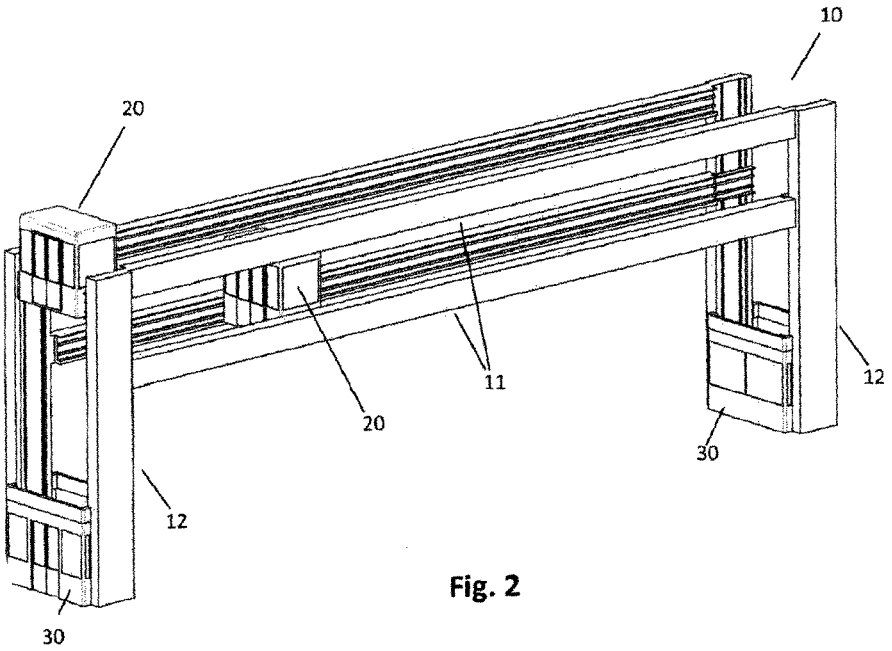
FIG. 2 is an isometric view of the urban elevator shifter system with portal structure (10), of the type with two or more cabins of transport (20) and two horizontal runways (11)

An elevator shifter system with portal structure (10), of which an example is shown in FIG. 2, with the rack (100, 101) or fixed chain, where the motor is rigidly coupled to the cabin of transport (20) and acts through a pinion gear (500) on the rack (100, 101) or on the fixed chain. In the case of rack (100, 101), to increase the fluidity of the movement with less vibrations and reduce the noise level of the system thus increasing the comfort of the passengers in the cabin of transport (20), is used an angled toothing.

In the case of an elevator shifter system with portal structure (10) with a single cabin of transport (20), to have a single system for moving the cabin that realizes both the vertical and horizontal movement, in order to realize a trajectory curve in corresponding to the passage from a vertical runway (12) to a vertical runway (11) and vice versa, which coupling between sections of vertical rack (101) and horizontal rack (100), is used and curved rack segment (102) in the shape of a circular sector of the pinion. The pinion gear (500) is driven by an electric motor (501) housed in a special compartment of the cabin of transport (20), or placed directly on the sledge (50) which is integral with the cabin of transport (20).

A single motor (501) can be replaced by a pair of motors (501) on the sides of the cabin or on the sledges (50) supporting it, which act separately with an electronic synchronism via encoder and closed loop control and/or as a couple through a shaft of synchronism (502). Such shaft of synchronism (502) can be conveniently placed through the floor (202) of the cabin of transport (20) below the same so as not to constitute alley and obstruction. The use of two electric motors (501) separated can realize a security system in the case where the movement of the cabin of transport (20) can also occur if one of the two motors or its control system is faulty.

The motor (501) or the motors (501) will be equipped with brake Shunt or analogous to that used in the electric winches for elevators, so as to ensure the maintenance in position of the cabin even in case of power failure due to breakdown or for the simple stationary purposes.

To counteract the forces that characterize the mating pinion (400)/rack (101) or the pinion (400)/chain (404), which would tend to turn away between them the two elements, can be prepared a special thrust bearing guide pin (403 and 503) concentric with the axis of the toothed pinion (400 and 500), which acts on a special guide surface thrust bearing (106) suitably shaped to follow and impose the movement of the thrust bearing guide pin (403 and 503) the same.

In the vertical sections, the same rack (101) can be used to ensure the parallel movement of the carriages (40) that move vertically the sledges (50) to which is integral the cabin (20). To achieve this there is provided a synchronous shaft (402) which at each end provides a toothed pinion (400) which engages on the rack (101) in its vertical section. On the same shaft (402) may be provided some brakes which allow to realize a braking system for the only vertical movement of the cabin (20). These brakes can be of electromagnetic type similar to those expected in the motors of winches for elevators.

To increase the transport capacity of an elevator shifter system with portal structure (10) as described in the preceding paragraphs, it is proposed a system of which an example is shown in FIG. 2, with two or more cabins (20) with two-way vertical runway (12) on opposite sides and with two or more horizontal runways (11). This system requires that two or more cabins (20) move on the two vertical sections (12) at the ends of the horizontal sections (11) and on two or more horizontal sections (11) in an autonomous but coordinated way, obtaining for example that, while in a cabin (20) at the end of a vertical runway (12) takes the loading or unloading, another cabin (20) can be in loading or unloading on the opposite side, or it can be in transit, even together with other cabins (20), if the total of the cabins (20) is three or more, along a part of the path constituted by the vertical runway (12) and horizontal runway (11) not engaged.

To obtain the movement of the cabins (20) in the solution in the preceding paragraphs, it is envisaged that the said cabins (20) are equipped with their own motor (501) or of a pair of motors (501) and two sledges (50) with motor (501) as in the previous paragraph. The vertical movement at the two ends of the invention, along its vertical runways (12), is obtained by means of a pair of carriages (40) that realize the continuation of the horizontal runways to the cabin (20) or the sledges (50) that support it. On these carriages (40) and integral to them is fixed an horizontal rack (104), which is a continuation of the rack arranged on the respective horizontal sections of the portal (10) and which allows the system with toothed pinions (500) of the cabin or the related sledges (50) to move horizontally along said carriages (40). Once the pair of carriages (40) is kept aligned with the relative horizontal runway (11), the cabin (20) or the sledges (50) on which it rests there may rise above always through the movement made by the motor (501) or by the motors (501) on the cabin (20) or on its sledges (50).

The vertical movement of the carriages (40) is obtained through a motor (401) or two motors (401) connected between them by a special synchronism shaft (402) or electronically controlled in a synchronous manner, such as for example in the position control in closed loop with encoder. In the case of single motor (401), it will carry out the movement of both carriages through the same shaft of synchronism (402). The pinions (400) at the ends of the shaft of synchronism (402) or motor (401) separately mesh on to suitable racks (105) arranged vertically on the vertical runways (12) also ensures the parallel movement of the carriages themselves.

On each of the two vertical sections (12), as represented by way of example in FIG. 13, may be provided for a pair of carriages (40) only, or two pairs of carriages (41), which move independently of each other. In the case of only one pair of carriages (40), a single cabin (20) at a time can be moved on the same path of the vertical runway (12). The pair of carriages (40), when it has not above a cabin, if not already previously positioned, present themselves in correspondence of the horizontal runway (11) from which comes the cabin (20) to move vertically. Once received the cabin (20) to move, the pair of carriages (40) carries it to the first station (30) in correspondence of the destination or to another of the horizontal runways (12) depending on the case. The cabins (20) can be so moved in a way independent but coordinated between them, exploiting the horizontal runways (11), such alternative paths or parking waiting.

Figure 1:
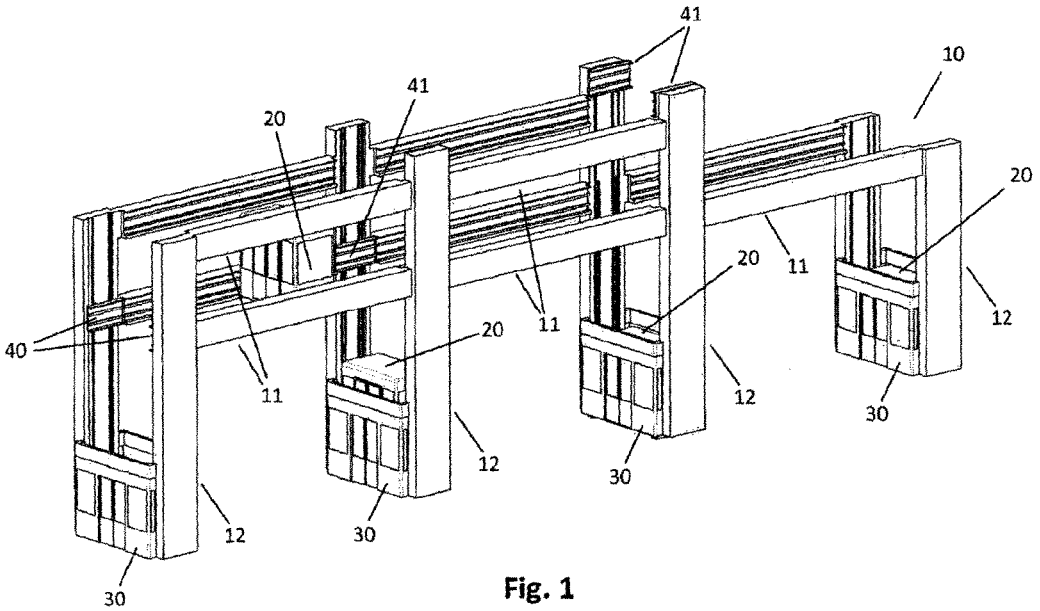
FIG. 1 is an isometric view of the urban elevator shifter system with portal structure (10), of the type with one or more cabins of transport (20), more than one horizontal runway (11) and more than two vertical runways (12)
Figure 3:
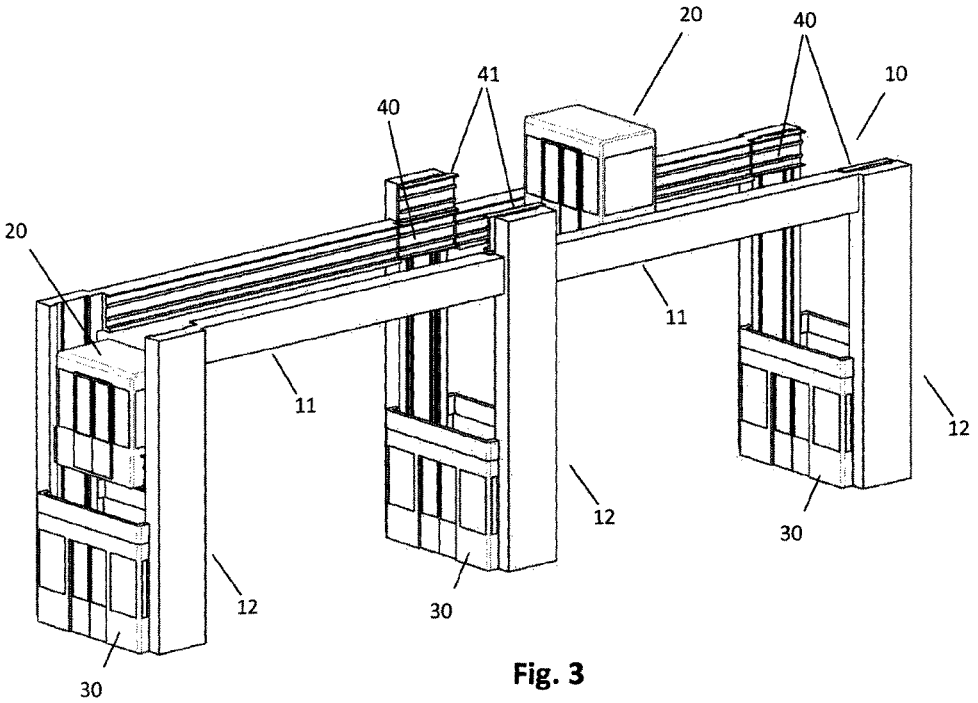
FIG. 3 is an isometric view of the urban elevator shifter system with portal structure (10), of the type with one or more cabins of transport (20) and more than two vertical runways (12)
Figure 4:
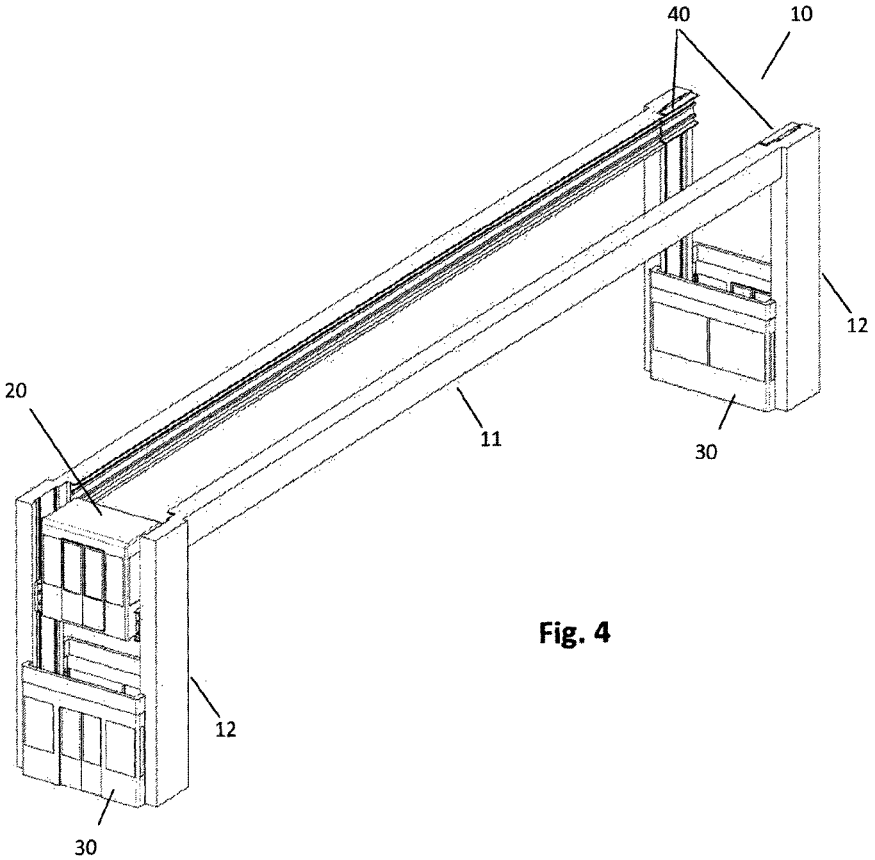
FIG. 4 is an isometric view of the urban elevator shifter system with portal structure (10), of the type with a cabin of transport (20) and one horizontal runway (11)
Figure 5:
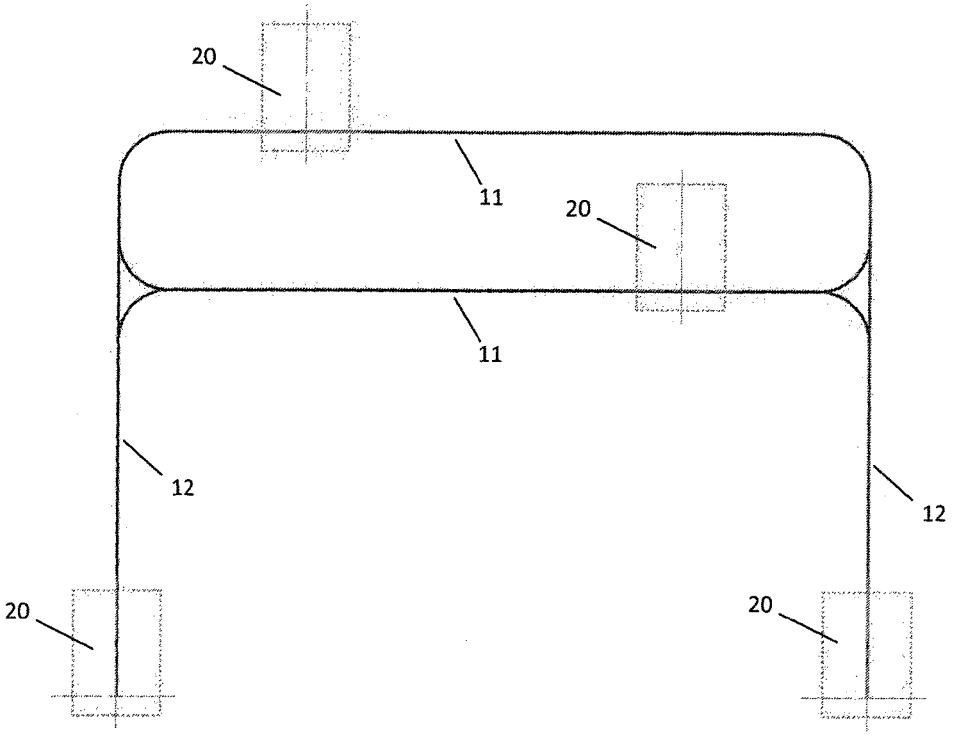
FIG. 5 is a schematic representation of the paths that each cabin of transport (20) can follow in the urban elevator shifter system with portal structure (10), of the type with one or more cabins of transport (20), with more than a path of the horizontal runway (11)
Figure 6:
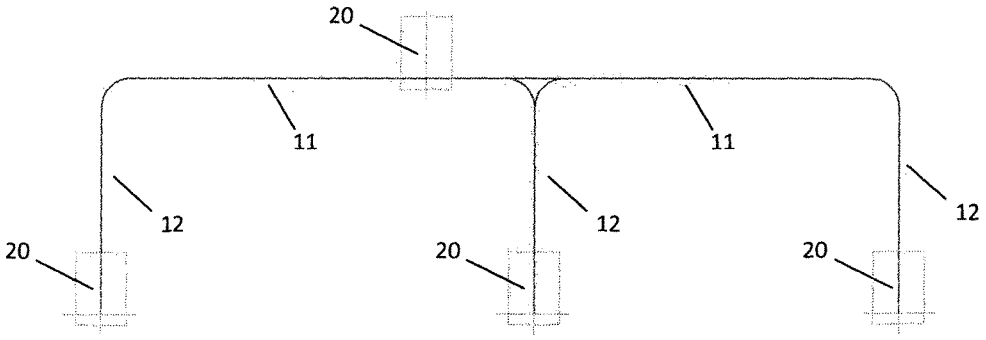
FIG. 6 is a schematic representation of the paths that each cabin of transport (20) can follow in the urban elevator shifter system with portal structure (10), of the type with one or more cabins of transport (20), with more than a way of vertical runway (12)
Figure 7:
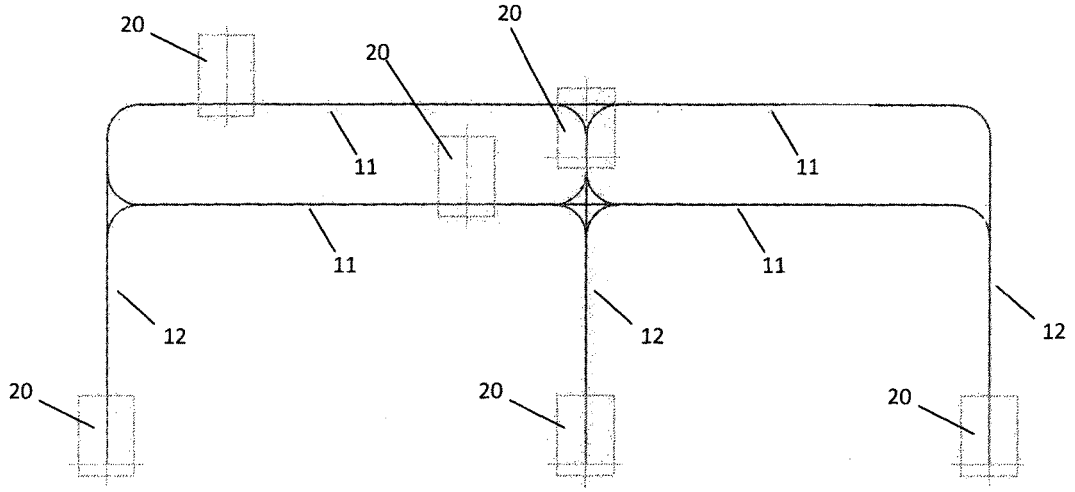
FIG. 7 is a schematic representation of the paths that each cabin of transport (20) can follow in the urban elevator shifter system with portal structure (10), of the type with one or more cabins of transport (20), with more than a path of the horizontal runway (11), with more than one route of the vertical runway (12)
Figure 8:
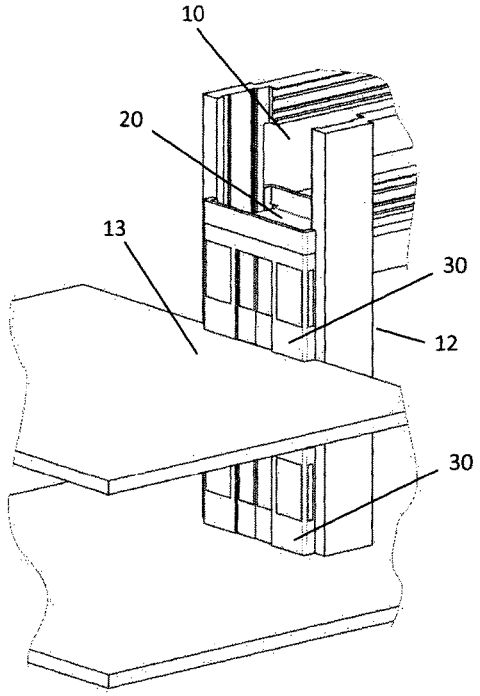
FIG. 8 is a partial isometric view of the urban elevator shifter system with portal structure (10), of the type with intermediate station (13) along a vertical runway (12)

To further increase the transport capacity of the elevator shifter system with portal structure (10) of which an example is shown in FIGS. 1, 3 and 13, may be provided on each of the vertical runways (11) a second pair of carriages (41) with capacity of autonomous movement, which can be parked if necessary in a raised position above the horizontal runway (11) higher. In this way, considering a specific vertical runway, while a pair of carriages (40) is engaged for example in the loading or unloading of a cabin (20), the other pair of carriages (41) can provide to transfer from an horizontal runway (11) to another, another cabin (20).

The cabins (20) can be so moved in a way independent but coordinated between them, exploiting the horizontal runways (11) and part of the way of the vertical runway (12) such alternative runways, as well as the horizontal runways (11) such as cabin parks waiting. With this, it is possible to address particular unbalanced loads of flow of people and things in the two opposite directions, having for example, the possibility of moving of the cabins (20) between an horizontal portion and the other even while other cabins (20) are simultaneously engaged in the loading and unloading stations (30).

To realize a gradual change of direction of the cabin (20) in correspondence of the passage from one way of the horizontal runway (11) to a way of vertical runway (12) and vice versa, the horizontal movement of the cabin (20) or the sledges (50) which is integral with the same, as well as the vertical movement of the carriages (40, 41) on which the cabin (20) or its sledges (50) rise, are adjusted by interpolation so as to make follow a curved and gentle path to the cabin (20), which has the same purpose delegated to the curved rack segment (102) of the preceding paragraphs.

The combination of the movement of the carriages (40, 41) with the movement of the sledges (50), obtained through the position control of the motors (401, 501) by the controller of the system, similarly to what happens in the interpolation of the axes of a machine tool numerical control, allow to realize a trajectory arc in correspondence of the passage between vertical and horizontal, and vice versa of the cabin (20).

In order to overcome a series of obstacles such as for example the tracks in a train station, it is proposed a solution of an elevator shifter system with portal structure (10), an example of which is shown in FIGS. 1 and 3, which provides three or more vertical runways (12) similar to those described in the preceding paragraphs solution and one or more horizontal runways (11), with one or more cabins (20) that move in such a way autonomous but coordinated between all stations (30) placed in the appendices of the portal structure (10) or at intermediate levels (13) along the vertical runways (12). This system includes one or more cabins (20) equipped with its own system of horizontal movement acting on suitable racks (103, 104) arranged horizontally on the horizontal runways (11) and on the carriages (40, 41) that realize the vertical movement of the same cabins (20). Such system provides as in the case of the system to the previous point of the pairs of carriages (40, 41) equipped with an own movement system, with one or more motors (401) which allows the displacement along the vertical runways (12) thus realizing the motion of the cabins (20) that are positioned above.

This system differs from that described in the preceding paragraphs for the fact of providing one or more vertical runways (12) intermediate to the extreme vertical runways. In addition, as shown in FIG. 1, it differs from the system of the preceding paragraphs, including the possibility that there may be all or only a portion of the horizontal runways (11) between the different vertical runways (12), more than one horizontal runways (11). The latter possibility allows to differentiate the movement capacity of the system, with respect to the different stations (30) placed at the ends of the portal structure (10) or on the intermediate floors (13) of the vertical runways (12).

In the case of a system with more than one cabin (20), in order to ensure a greater movement capacity of the system, each of the intermediate vertical sections that intersects one or more horizontal runways (11), needs two pairs of carriages (40 and 41) as described in the preceding paragraphs in such a way that, while a cabin (20) is located for example, in a station (30) for the operations of loading and unloading, engaging a pair of carriages (40), another pair of carriages (41) shall implement the continuity of the way of the horizontal runway (11) so that another cabin (20) transits there above.

Prerequisite for achieving such an elevator shifter system with portal structure (10) with more of a cabin (20) is the ability to move independently between them the cabins (20) optimizing the use of horizontal runways (11) and vertical runways (12). A control system of the electronic type with microprocessor easily realizes the control of the whole system by coordinating and controlling the movement of the cabins (20).

The superposition of two horizontal runways (11) allows to realize an arch able to overcome greater distances through simply going to unite the elements, in the manner of trellis for example, the beams that form the respective horizontal runways (11).

The vertical runways (12) are equipped with at least a pair of said carriages (40 and 41) that realize the continuation of the horizontal runways (11) in correspondence of the relevant vertical runways (12) so that the cabins (20) can come over to be able to realize the vertical movement. Both in ascent and descent of that, such a pair of carriages (40 and 41) will dispose themselves in correspondence of the way of the horizontal runway (11) towards which is bound the cabin (20) or from which comes the cabin (20). When the cabin (20) is on said carriages (40 and 41), through their vertical movement uphill or downhill is also achieved the ascent and descent of the cabin (20). The independent movement of said carriages (40 and 41) is obtained by a special motor (401) or pair of motors (401) integral to the same acting through toothed pinions (400) on special racks (105)

arranged vertically along the columns that form the vertical sections (12) of the arch with a portal structure (10). In alternative to the system with the rack, the carriages (40 and 41) can be moved by special chains (404), moved in turn by one or more stationary motors (405), integral to the structure, which act via pinions (406) of said chains (404). In the case of a single motor (405) that realizes the movement of said chains (404), the same are synchronized with each other through a special shaft of synchronism (407) placed for example in the lower part of the vertical runway (12), and in so as not to obstruct the movement of the cabins (20).

In the elevator shifter system with portal structure (10), with more of a cabin (20) described above in its various configurations, for the movement of the cabins (20) along the horizontal sections, as an alternative to the rack (103 and 104) is possible to use wheels coated in non-slip material, which are kept in adherence on the guide rails and which are moved by electric motors (501) similarly to what happens to the pinions (500) which meshes on to the racks.

The said movement system comprises the device of hydraulic balancing of the weight of the cabin (20) in the case of vertical path of adaptive type. In essence, to achieve the purpose described here, is used a device that provides a system of hydraulic spring (601) of variable capacity for each of the carriages (40 and 41) that realize the movement of the cabins (20) along the vertical runways (12). Said device includes a single hydraulic energy storage system (600) (hydropneumatic accumulators) for all systems of hydraulic spring (601), or a number of hydraulic energy storage systems (600) for each of the systems of hydraulic spring (601) (multiple accumulations) preferentially located in proximity of the systems of hydraulic spring (600) themselves. In addition, this device includes a connecting pipe (602) that connects the only hydraulic energy storage system (600) with the different systems of hydraulic spring (601) or different accumulations of hydraulic energy (600) of each of the individual systems of hydraulic spring (601) between them. On this way, the hydraulic fluid (603) consumed or produced by a system of hydraulic spring (601) operated through a system of chain transmission (604) from the relevant carriages (40 and 41) of a vertical portion (12) during its vertical movement and the consequent energy (pressure variation) that it produces or consumes, can be recovered and consumed, respectively, from the same or a different system of hydraulic spring (601) driven by the relative carriage (40) which moves in the opposite direction with the same load. Even in the case of several cabins (20), if all move to and from the same level, apart from the losses due to leakage and the inevitable losses of the hydraulic systems, after that all the loads have been reported on the same floor by which had been taken, it will be obtained that the energy or hydraulic pressure of the hydraulic energy storage system of single (601) or hydraulic energy storage systems of the individual systems of hydraulic spring (600) is restored to the initial value thereby accomplishing energy recovery. Hydraulic springs (601) are of variable capacity, governed by an electronic system that, based on the weight of the load which insists on the cabin (20), detected through special load cells, determine the power of the hydraulic springs (601) themselves.

The same function of hydraulic spring (601) variable capacity obtained through a set of hydraulic cylinders (605) with different surfaces of thrust or power, suitably chosen to achieve a scale of powers that act in such a way as to balance the system in an appropriate weight of the cabin (20) in a system of vertical and horizontal movement, can be obtained from a set of pumps/hydraulic motors (606) with different displacements acting on a toothed pinion (400) meshing with a rack (105) or to a fixed chain. This set of pump/motor hydraulic will transform, similar to the hydraulic cylinders (605), the energy possessed by the hydraulic fluid (603) or pressure, in moving mechanical linear system through said pinion (400)/rack (101) or the one sprocket/fixed chain. The set of pumps/hydraulic motors described here can advantageously act on the same shaft of synchronism (402) that connects a pair of carriages (40 and 41), both in the case that they are provided with their own electric motor (401) that in one in which they are lacking of. The set of pumps/hydraulic motors described here can advantageously be replaced by a pump/motor of variable hydraulic displacement which allows to modify the power according to the load of the cabin (20).

The balancing adaptive system referred already described in D4 and the one here provided in the preceding paragraphs that is the evolution of the same, can be used even in these systems even in the case of transfer of loads to be transported from the cabins (20) from and to different floors between them, provided that in such systems be provided the maintaining of the pressure in the hydraulic energy storage system (600) (hydropneumatic accumulators) within defined values using an hydraulic pump (607) moved from its motor (608) and a control valve pressure (609). Through these elements, a prevailing pressure loss (consumption of hydraulic energy), for example caused by the displacement of the prevailing loads from the lower floors to the upper floors, or by the acquisition of energy (pressure increase), caused for example by the shift of the prevailing loads from upper floors to lower floors, respectively, will be compensated by the energy supplied by the hydraulic pump (607) and that consumed by the pressure regulating valve (608), respectively. The hydraulic pump (607) withdraws in fact the hydraulic fluid (603) from the reservoir (610) and compresses the interior of the accumulator (600), while the valve adjustment pressure, transfers the hydraulic fluid (603) in excess in the accumulators (600), in the tank (610). The hydraulic system of balancing will act ultimately in the same way as an elevator system with hydraulic control contributing to the lifting of loads that must be moved from a lower plane to a higher plane. The energy required for lifting a load which is subsequently recovered from dropping the same load, will be supplied by the motor (608) that drives the pump (607).

An advantage in terms of energy can result in the proposed solution, by preparing accumulations (600) (hydropneumatic accumulators) more capacious and/or an hydraulic motor (611) powered by the fluid in output from the pressure regulating valve (609) here provided, which in turn moves an electric current generator (612). The electricity produced by the generator (612) can be fed back into the mains of withdrawing or consumed by other parts of the system or its accessories.

An effective system of protection of the organs that perform the horizontal movement of the cabin (20) is given by a cover (107) that completely covers from the side such organs along the horizontal runways (11). Below this cover (107), may be protected all the mechanical and electrical connection of all systems. In this way, the cabin (20) can be supported and connected to the sledges (50) or to the part of the same cabin (20) which acts as a sledge, through the shelves (503) which keep it raised from under the floor. The opening of shelves passage (108) through which pass these shelves (503) will be as small as possible and may in turn be protected by brushes or flexible membranes. The position of this opening of shelves passage (108) and its size are such as to prevent external elements such as water, snow, dust, etc. from entering the premises in which they find space the movement devices.

Exploiting the particular suspension system of the cabin (20) from below the bottom or floor (202), realized by means of the shelves (503) described previously, it is possible to obtain on the side walls of the cabin (20) some openings (200), which will normally be closed by a door (201), through which it can be accessed directly from the cabin (20) to the covers (107), and once removed the latter, to the sledges (50) and possibly also to the carriages (40 and 41). Through the openings (200) of the cabin (20), will therefore be possible to perform control operations and maintenance on the organs of horizontal movement of the cabin (20).

An effective system for optimizing the movement and coordination of the elevation and shifting of the cabins (20) in an elevator shifter system with portal structure (10) with more than one cabin (20), is achieved by applying an artificial vision system in the vicinity of stations (30) or access to the areas through which users converge toward the stations (30). Through the interpretation of the data collected from such a vision system, the artificial intelligence system can:

- Calculate the number of users who are getting ready to climb
- Calculate the time of entry into the cabin (20)
- Develop help message or warning that influence the behavior of users.
- Recognize the type of users, based on the speed of movement, to the stature, to the objects transported, means of aid used, apparent age, to a particular state (pregnancy, pathology, etc.), etc.

Based on all this, the artificial intelligence system can:

- Ensure the handling of the cabins (20) in order to bring them closer to the stations (30) where there is greater need.
- Provide a pre-calculation of the route and the speed of movement of the cabins (20) without waiting for the command of the user.
- Optimize the paths of the cabins (20).
- Support, through visual signals and/or noise, the users, with a particular focus, for example, on those with mobility difficulties, etc.
- Through a system of acquisition of sounds, the artificial intelligence system can further characterize the users, for example, recognizing the language and adapt accordingly its visual and audio signals. The artificial intelligence system may be prepared for self-learning in order to further optimize the efficiency of the plant. The process of self-learning can be made so:
  - Development of sound and image data continue relating to a specific station (30) said "in progress", with update of an array of data called "needs to be processed", until the occurrence of a "key" event which, for example, the manual start call of the cabin (20) from the station "in process".
  - Freezing and storage of the data matrix of "needs to be processed" in a special database called "experience."
  - Development of "needs to be processed" according to the logic "wired" of the system with the production of a "work order processed", with calculation of a predicted "reports of predicted work."
  - Recovery from the database "experience" of a small number of "needs" already processed previously called "nearby needs" among the closest (relative closeness of the values of the matrix) to the "needs to be processed." Contemporary retrieval from the database "experience" of "work orders" applied to "nearby needs". Contemporary retrieval from the database "experience" of "reports of work" related to "work orders" applied to "nearby needs".
  - Execution of the work order chosen as the best among "work order calculated" and "close work orders" based on the relative data of the "report of predicted work" and "work reports" of "nearby work orders".
  - Memorizing work order chosen in the previous step as a "work order in processing"
  - At the completion of the last phase of the work "work order in processing", storing the same as "order of historical work" and storing the related "report of work."
  - Cyclical repetition of all the steps described above for each of the stations (30) of the system.
- Through the extension of the data processed by the system of artificial intelligence and an appropriate weighting of the parameters that influence the choices of self-learning system described above, the elevator shifter movement system will implement more efficient work cycles.

| References | |
|---|---|
| (10) | Portal Structure |
| (11) | Horizontal runaway |
| (12) | Vertical runaway |
| (13) | Intermediate plane |
| (20) | Transport Cabin |
| (30) | Station |
| (40) | Carriage |
| (41) | Carriage |
| (50) | Sledge |
| (100, 101, 103, 104, 105) | Rack |
| (102) | Segment of curved rack |
| (106) | Thrust-bearing guide surface |
| (107) | Covering |
| (108) | Opening of shelves passage |
| (200) | Cabin lateral opening |
| (201) | Maintenance door |
| (202) | Floor |
| (400, 500) | Toothed pinion |
| (401, 501) | Electric Motor |
| (402, 407, 502) | Synchronism shaft |
| (403, 503) | Thrust-bearing guide pin |
| (404) | Chain |
| (405) | Fixed Motor |
| (406) | Chain Pinion |
| (504) | Shelf |
| (600) | Hydraulic energy accumulation |
| (601) | Hydraulic spring |
| (602) | Connecting pipe |
| (603) | Hydraulic fluid |
| (604) | Return Chain |
| (605) | Hydraulic Cylinder |
| (606) | Pump/Hydraulic Motor |
| (607) | Hydraulic Pump |
| (608) | Hydraulic Pump Motor |
| (609) | Pressure regulating valve |
| (610) | Tank |
| (611) | Hydraulic motor |
| (612) | Electric generator |

The invention claimed is:

1. A vertical and horizontal movement system of one or more cabins (20) for the transport of people and things in an elevator shifter apparatus with a portal structure (10), wherein, the cabin (20) is actuated by a rack (100, 101, 103, 104, 105) where a motor (405) is integral to the cabin (20) and acts via a toothed pinion on the rack (100, 101, 103, 104, 105), and the toothed pinion is a helical gearing; wherein the vertical and horizontal movement system provides more than one cabin (20), with two or more horizontal runways (11) and more than two vertical runways (12), in which one or more vertical runways (12) include intermediate stops or stops placed at different levels, and wherein one or more horizontal runways (11) include intermediate stops and descents placed at different levels so such that they can overcome obstacles also passing under the same;

wherein the cabin (20) uses two pairs of carriages (40 and 41) on the same path of a vertical runway (12) in such a way as to obtain the simultaneous movement of more than one cabin (20) on the same path of the vertical runway (12) and, in the case of more than two vertical runways (12), in such a way as to ensure the passage of the cabin (20) from a path of a horizontal runway (11) to another path of a horizontal runway (11) adjacent, overpassing the same path of vertical runway (12) considered.

2. The vertical and horizontal movement system of one or more cabins (20) for the transport of people and things in the elevator shifter apparatus with the portal structure (10), according to claim 1, wherein the vertical and horizontal movement system comprises a device that provides a system of hydraulic spring (601) of variable capacity for each of carriages (40 and 41) that realize movement of the cabins (20) along a vertical runways (12), and the device includes a single hydraulic energy storage system (600) for all systems of hydraulic spring (601), or a number of hydraulic energy storage systems (600) for each of the systems of hydraulic spring (601) preferentially located in proximity of the systems of hydraulic spring (600) themselves; the device also includes a connecting pipe (602) that connects the only hydraulic energy storage system (600) with the different systems of hydraulic spring (601) or different accumulations of hydraulic energy (600) of each of the individual systems of hydraulic spring (601) between them.

3. The vertical and horizontal movement system of one or more cabins (20) for the transport of people and things in the elevator shifter apparatus with the portal structure (10), according to claim 1, wherein the vertical and horizontal movement system comprises a pair of motors (401, 501) placed on sides of the cabin (20) or on sledges (50), the motors (401, 501) act separately through a synchronism shaft (402, 407, 502), said synchronism shaft (402, 407, 502) being placed under the cabin (20) or at the inside of the bottom of the cabin (20) in such a way as not to constitute bond and obstruction.

4. The vertical and horizontal movement system of one or more cabins (20) for the transport of people and things in the elevator shifter apparatus with the portal structure (10), according to claim 1, wherein in vertical runways (12), the said rack (100, 101, 103, 104, 105) is used to ensure the parallel movement of the carriages (40) that move vertically sledges (50) to which is integral the cabin (20), being provided a synchronization shaft (402, 407, 502) that at each end provides the toothed pinion (400, 500) which engages on the rack (100, 101, 103, 104, 105) in the vertical runways (12).

5. The vertical and horizontal movement system of one or more cabins (20) for the transport of people and things in the elevator shifter apparatus with the portal structure (10), according to claim 1, wherein the vertical and horizontal movement system comprises a special thrust bearing pin (403, 503) concentric with the axis of the toothed pinion (400, 500), which acts on an appropriate surface of thrust bearing guide (106) suitably shaped to follow and impose the movement of the pin itself (403, 503) in such a way as to counteract the thrusts that characterize the coupling pinion (400)/rack (101) or the pinion (400)/chain (404), which would tend to turn away between them the two elements.

6. The vertical and horizontal movement system of one or more cabins (20) for the transport of people and things in the elevator shifter apparatus with the portal structure (10), according to claim 1, wherein the vertical and horizontal movement system comprises a system of protection of the parts that realize the horizontal movement of the cabin (20), given by a cover (107) that completely covers from the side the said parts along the horizontal runways (11), allowing to support the cabin (20) through some shelves (503) that pass beneath said cover (107), sliding through an opening (108) that is directed toward the bottom and which therefore prevents extraneous elements contaminating the compartment of the parts of movement along the horizontal runways (11).

* * * * *